US010123122B2

(12) United States Patent
Katsumata

(10) Patent No.: US 10,123,122 B2
(45) Date of Patent: Nov. 6, 2018

(54) ELECTROACOUSTIC TRANSDUCER

(71) Applicant: YAMAHA CORPORATION, Hamamatsu-shi (JP)

(72) Inventor: Yoshihiro Katsumata, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/389,485

(22) Filed: Dec. 23, 2016

(65) Prior Publication Data

US 2017/0105072 A1 Apr. 13, 2017

Related U.S. Application Data

(63) Continuation of application No. PCT/JP2015/068582, filed on Jun. 26, 2015.

(30) Foreign Application Priority Data

Jun. 27, 2014 (JP) ..... 2014-132522

(51) Int. Cl.
*H04R 1/00* (2006.01)
*H04R 9/02* (2006.01)
*H04R 1/02* (2006.01)

(52) U.S. Cl.
CPC ..... *H04R 9/02* (2013.01); *H04R 1/025* (2013.01); *H04R 2400/01* (2013.01); *H04R 2400/11* (2013.01)

(58) Field of Classification Search
CPC . H04R 7/127; H04R 7/14; H04R 7/16; H04R 7/18
See application file for complete search history.

(56) References Cited

U.S. PATENT DOCUMENTS 1,821,469 A * 9/1931 Hicks ..... H04R 7/12 181/169
1,866,090 A * 7/1932 De Forest ..... H04R 1/24 181/173

(Continued)

FOREIGN PATENT DOCUMENTS

DE 3620557 A1 12/1987
EP 1182907 A2 2/2002

(Continued)

OTHER PUBLICATIONS

Extended European Search Report issued in European Appln. No. 15810941.3 dated Jan. 23, 2018.

(Continued)

*Primary Examiner* — Matthew Eason
*Assistant Examiner* — Ryan Robinson
(74) *Attorney, Agent, or Firm* — Rossi, Kimms & McDowell LLP

(57) ABSTRACT

An electroacoustic transducer, which can be a speaker or a microphone, includes a frame, a housing, and a vibrating body having one or more vertically split cylindrical faces. The opposing sides of the vibrating body is connected to the housing or the frame. A conversion section converts an electrical signal into vibration of the vibrating body or vibration of the vibrating body to an electrical signal. The vibrating body can extend to the side surfaces of the housing or completely wrap around the housing.

16 Claims, 14 Drawing Sheets

(56) References Cited

U.S. PATENT DOCUMENTS

Figure 1:
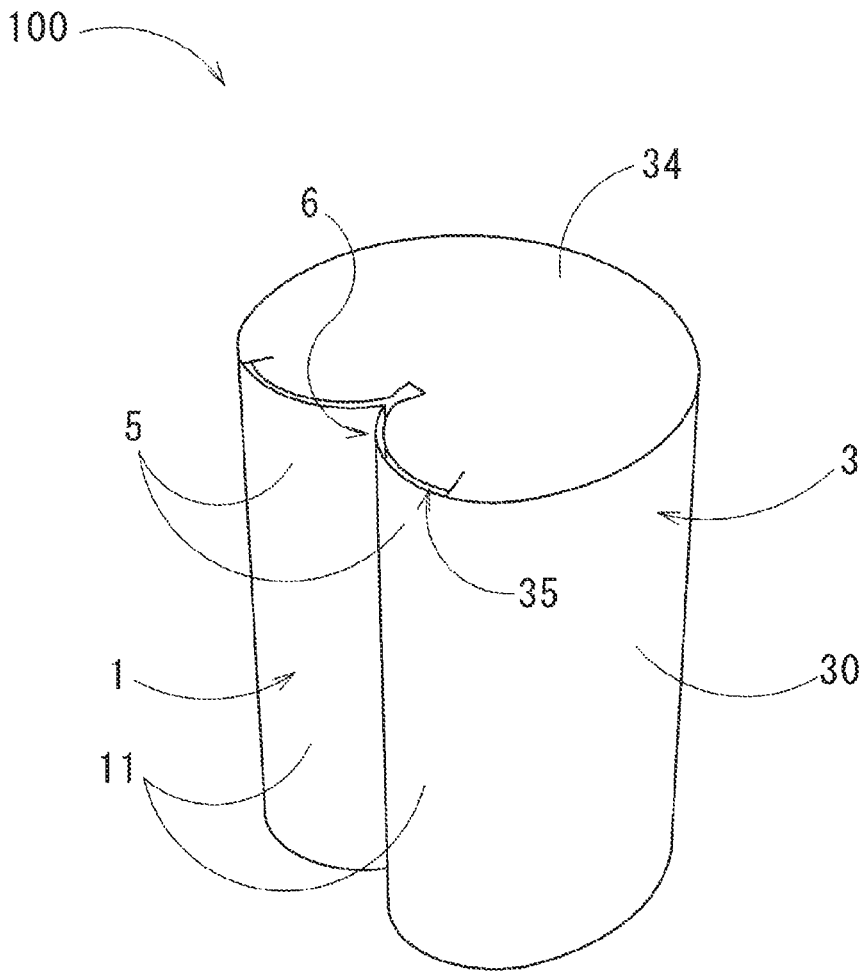

| | | | | | |
|---|---|---|---|---|---|
| 4,903,308 | A * | 2/1990 | Paddock | ..... | H04R 7/02 181/153 |
| 5,450,497 | A * | 9/1995 | Paddock | ..... | H04R 7/12 381/186 |
| 5,570,429 | A * | 10/1996 | Paddock | ..... | H04R 7/127 381/398 |
| 5,652,801 | A * | 7/1997 | Paddock | ..... | H04R 17/00 381/173 |
| 8,027,503 | B2 * | 9/2011 | Konuma | ..... | H04R 7/127 181/171 |
| 9,106,988 | B2 * | 8/2015 | Noro | ..... | H04R 7/12 |
| 9,398,376 | B2 * | 7/2016 | Noro | ..... | H04R 9/06 |

FOREIGN PATENT DOCUMENTS

| | | | | | |
|---|---|---|---|---|---|
| JP | S6336889 | Y2 | 9/1988 | | |
| JP | 2002078079 | A | 3/2002 | | |
| JP | 3521319 | B2 | 4/2004 | | |
| JP | 2008252265 | A | 10/2008 | | |
| JP | 5191796 | B2 | 5/2013 | | |
| JP | 5668233 | B1 * | 2/2015 | ..... | H04R 7/18 |
| WO | 2011073497 | A1 | 6/2011 | | |

OTHER PUBLICATIONS

International Search Report issued in Intl. Appln. No. PCT/JP2015/068582 dated Aug. 25, 2015. English translation provided.

Written Opinion issued in Intl. Appln. No. PCT/JP2015/068582 dated Aug. 25, 2015.

Office Action issued in Japanese Appln. No. 2014-132522 dated Jun. 19, 2018. English Translation provided.

* cited by examiner

ELECTROACOUSTIC TRANSDUCER

BACKGROUND

Speakers having a curved diaphragm, such as Ryffel-type speakers, are known as a type of various speakers for reproducing sound. For example, Patent Document 1 (Japanese Utility Model Patent No. B6336889) discloses an illumination apparatus with a speaker where a diaphragm (speaker diaphragm) is made of a light-transmittable material and used as a protection cover of a lighting lamp. In this illumination apparatus with the speaker, the diaphragm is installed on a box-shaped frame.

Furthermore, Patent Document 2 (Japanese Patent No. 3521319) discloses a speaker where two vertically split cylindrical diaphragms, namely having longitudinally divided cylindrical surfaces, are integrally disposed in parallel in the same direction and the edges of the diaphragms are fixed to a frame. In addition to the above-mentioned speaker, Patent Document 2 also discloses a speaker where two sets of vertically split cylindrical diaphragms, closed from each other, are disposed integrally in parallel in a circumferential direction and a speaker where four vertically split cylindrical diaphragms are disposed back to back in parallel. These four diaphragms are configured so that the joining sections of the respective diaphragms are supported by the magnetic circuits or the voice coil bobbins disposed inside, and all the diaphragms are disposed so that the curved faces thereof are directed outward.

Moreover, Patent Document 3 (Japanese Patent No. 5191796) discloses a speaker where two diaphragms are provided in parallel and both the end sections of the diaphragm are elastically supported by a frame so that the central section of the diaphragm is curved. The frame of this speaker has an almost line-symmetric shape where a pair of flat plate sections is connected to each other with a central connection section.

The structures of the speakers disclosed in Patent Documents 1 to 3 described above can be applied to microphones having an operation principle opposite to that of speakers. As disclosed in Patent Documents 1 to 3 described above, speakers having a curved diaphragm are configured so that the end sections of the diaphragm are fixed to a rectangular frame, and the diaphragm and the housing of each speaker are separated in the external appearance of the speaker, so that the speakers have similar external appearances. But since the tastes of consumers have diversified, it is desirable to further improve the design property of this kind of electroacoustic transducer.

In addition, in these speakers disclosed in Patent Documents 1 to 3, design and acoustic characteristics utilizing the shapes of the curved diaphragms have not yet been achieved.

There remains a need for an electroacoustic transducer having a curved vibration face and being excellent in acoustic characteristics and excellent in design property. The present invention addresses this need.

SUMMARY

One aspect of the present invention is an electroacoustic transducer, which can function as either a speaker or a microphone. The electroacoustic transducer includes a vibrating body, an actuator, a frame supporting the actuator, and a housing defining a chamber with an opening having a first side and a second side.

The vibrating body has at least a first pair of longitudinally divided cylindrical surfaces providing a first valley and having a first side portion on one side (which can be disposed left/right or lower/upper side) of the first valley and a second side portion on the opposite side (which can be disposed right/left or upper/lower side) of the first valley. The actuator is connected to the vibrating body, in particular connected to where the first pair of longitudinally divided cylindrical surfaces meet, and is configured to convert one of an electrical signal into vibration of the vibrating body or vibration of the vibrating body into an electrical signal.

The frame supports the actuator and is connected to the housing adjacent to the opening thereof with the actuator disposed inside the housing. The first side portion of the vibrating body can be attached to the housing at the first side of the opening, and the second side portion of the vibrating body can be attached to the housing at the second side of the opening, which is opposite the first side of the opening, so that the vibrating body covers the opening.

The housing has, at the first side of the opening, a first end surface, and has, at the second side of the opening, a second end surface. The first and second side portions of the vibrating body can respectively extend past the first and second end surfaces and connect to an exterior surface of the housing. The first and second side portions of the vibrating body also can be respectively attached to the first and second end surfaces of the housing. The vibrating body also can extend completely around the exterior surface of the housing. The first and second side portions of the vibrating body also can be disposed flush with the exterior surface(s) of the housing contiguous with the opening.

First and second ends of the first and second side portions of the vibrating body can be respectively attached to the frame using a first edge (surround) and a second edge (surround) that are supported on the frame to enable the vibrating body to reciprocate in a depth direction of the first valley in relation to the housing.

The actuator can include a magnet mechanism fixed to the frame and a voice coil movably supported relative to the magnet mechanism and connected to the vibrating body where the first pair of longitudinally divided cylindrical surfaces meet. The voice coil can be configured to convert an electrical signal into vibration of the vibrating body to provide a speaker function. The voice coil can be configured to convert vibration of the vibrating body into an electrical signal to provide a microphone function.

The longitudinally divided cylindrical surfaces of the first pair can be parallel in relation to the housing.

The housing can have a front flat face where the opening is provided. The first side portion of the vibrating body can be disposed on a first side of the front flat face and the second side portion of the vibrating body can be disposed on a second side of the front flat face.

The electroacoustic transducer can include a second pair of longitudinally divided cylindrical surfaces providing a second valley. The second pair of longitudinally divided cylindrical surfaces can have an identical or different configuration as the first pair of longitudinally divided cylindrical surfaces.

Since the vibrating body and the housing can have design with a smooth integral feeling without being distinguished from each other, an electroacoustic transducer being excellent in acoustic characteristics and excellent in design property can be provided.

BRIEF DESCRIPTIONS OF THE DRAWINGS

FIG. 1 schematically illustrates a perspective view of a first embodiment of a speaker according to the present invention.

Figure 2:
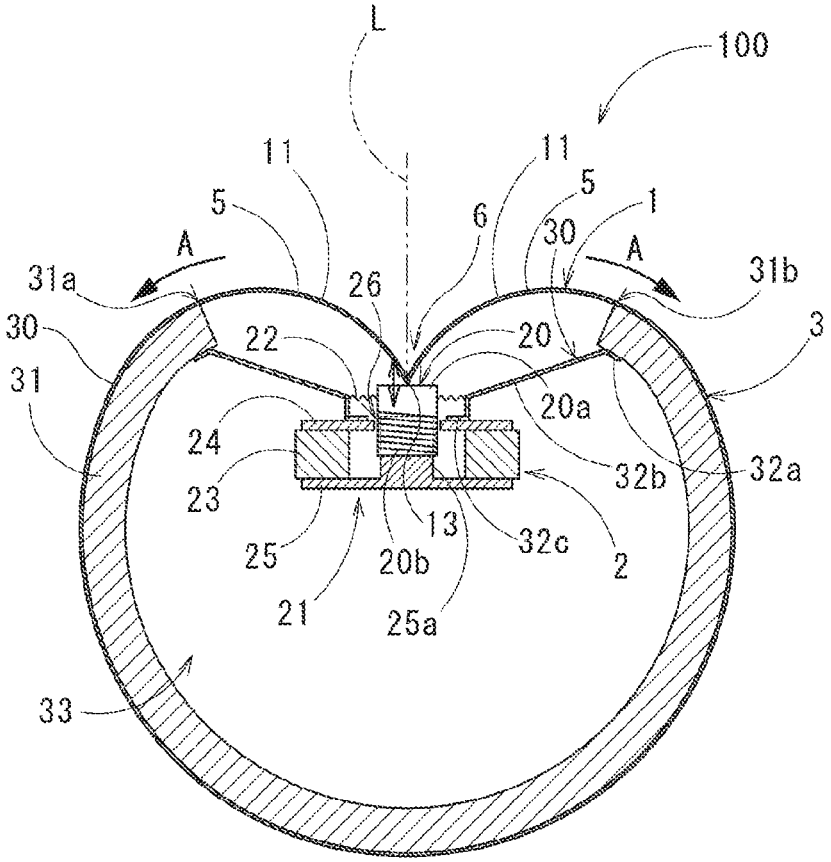

FIG. 2 schematically illustrates a cross-sectional view showing the speaker shown in FIG. 1.

Figure 3:
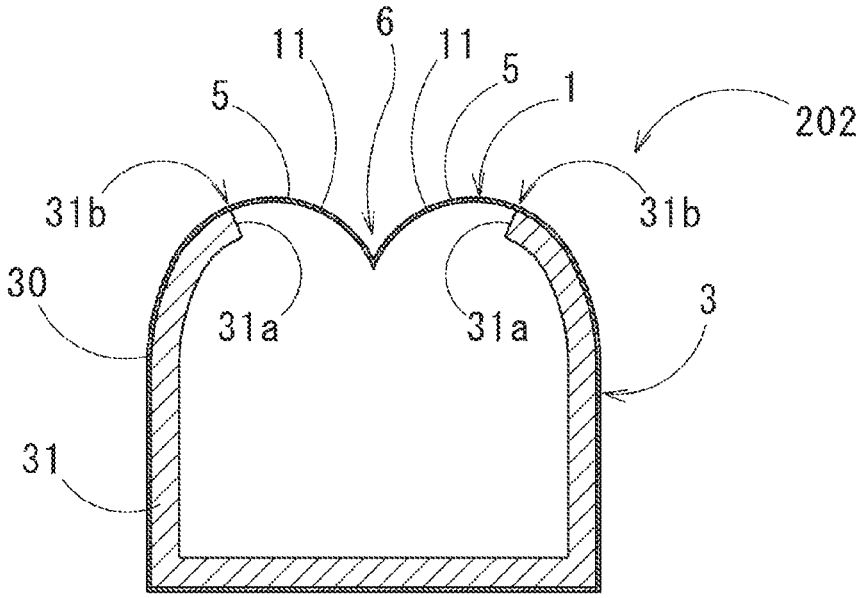

FIG. 3 schematically illustrates a cross-sectional view of a second embodiment of a speaker according to the present invention.

Figure 4:
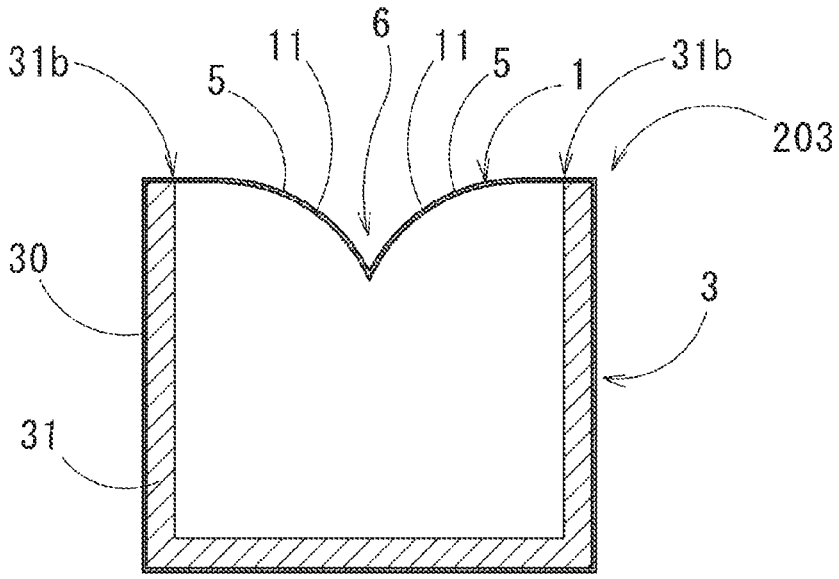

FIG. 4 schematically illustrates a cross-sectional view of a third embodiment of a speaker according to the present invention.

Figure 5:
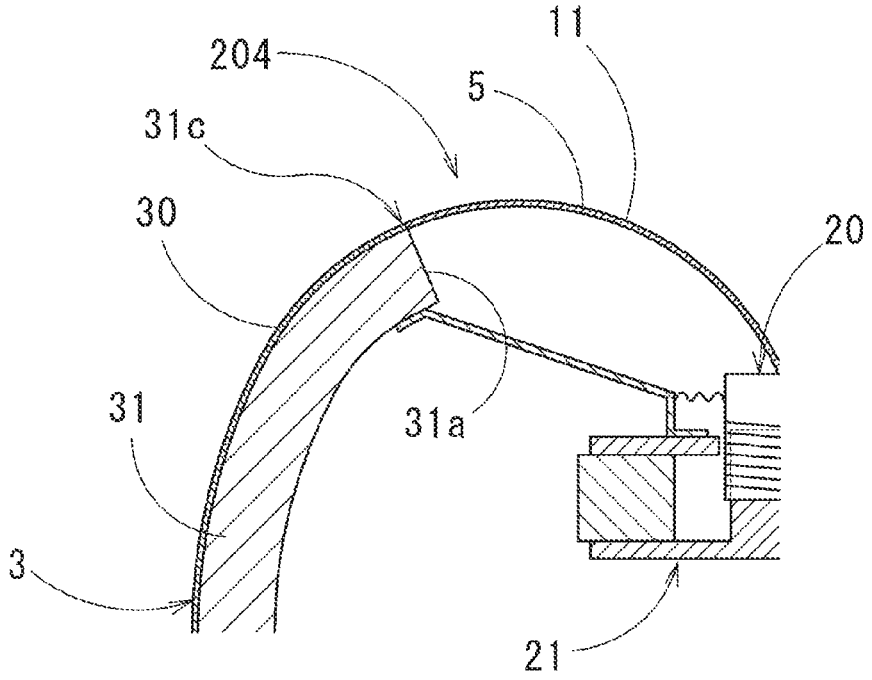

FIG. 5 schematically illustrates a partial cross-sectional view of a fourth embodiment of a speaker according to the present invention.

Figure 6:
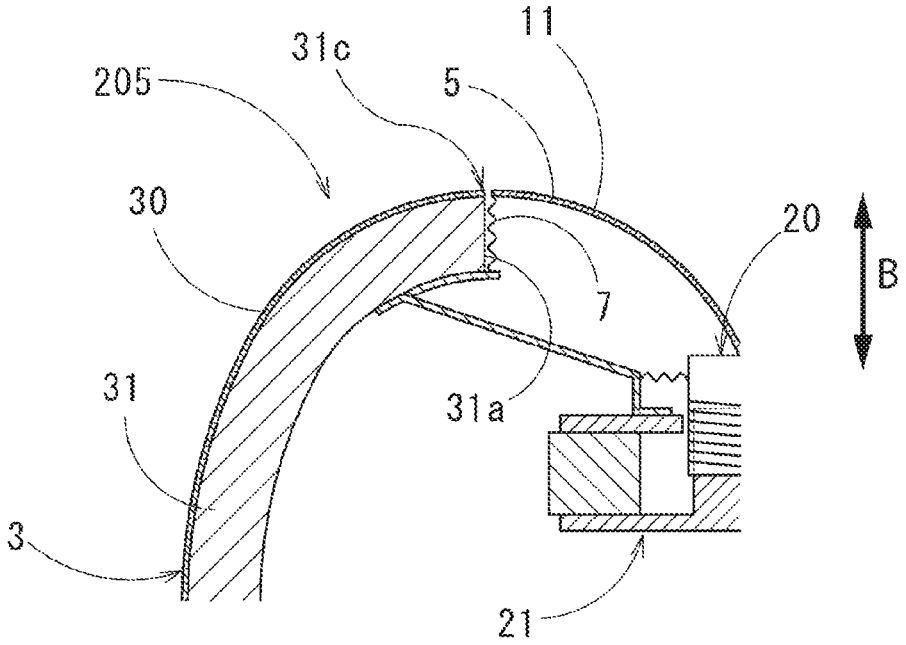

FIG. 6 schematically illustrates a partial cross-sectional view of a fifth embodiment of a speaker according to the present invention.

Figure 7:
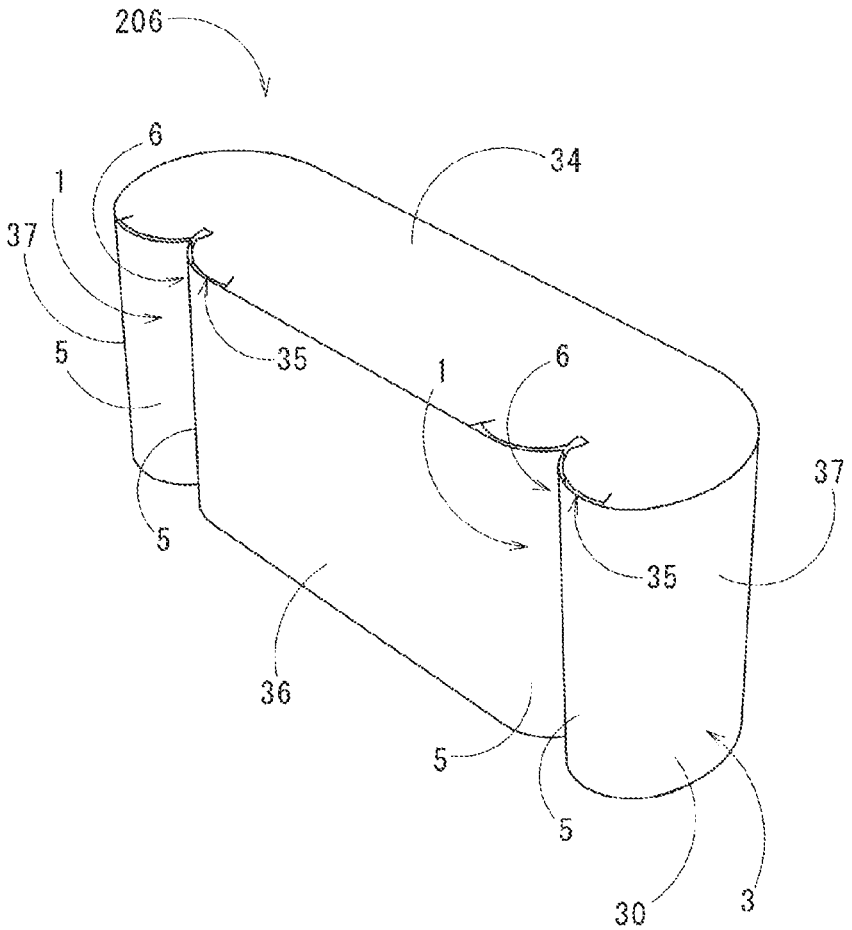

FIG. 7 schematically illustrates a perspective view of sixth embodiment of a speaker according to the present invention.

Figure 8:
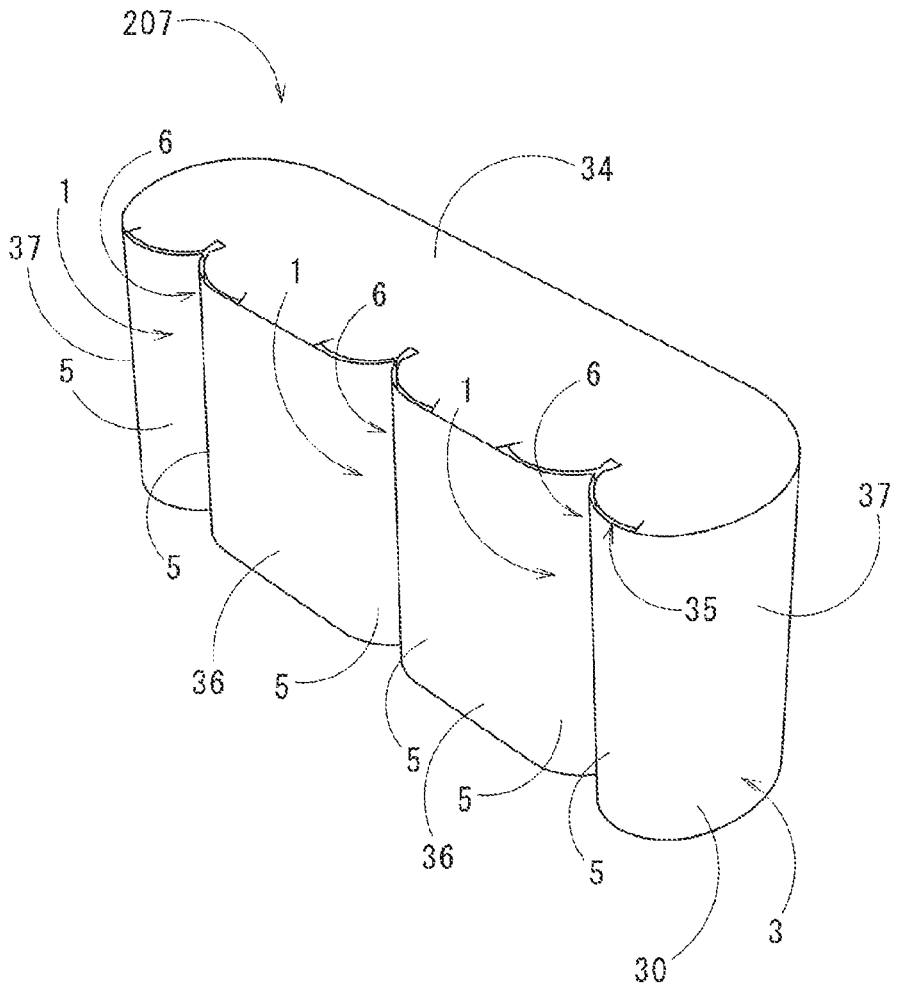

FIG. 8 schematically illustrates a perspective view of a seventh embodiment of a speaker according to the present invention.

Figure 9:
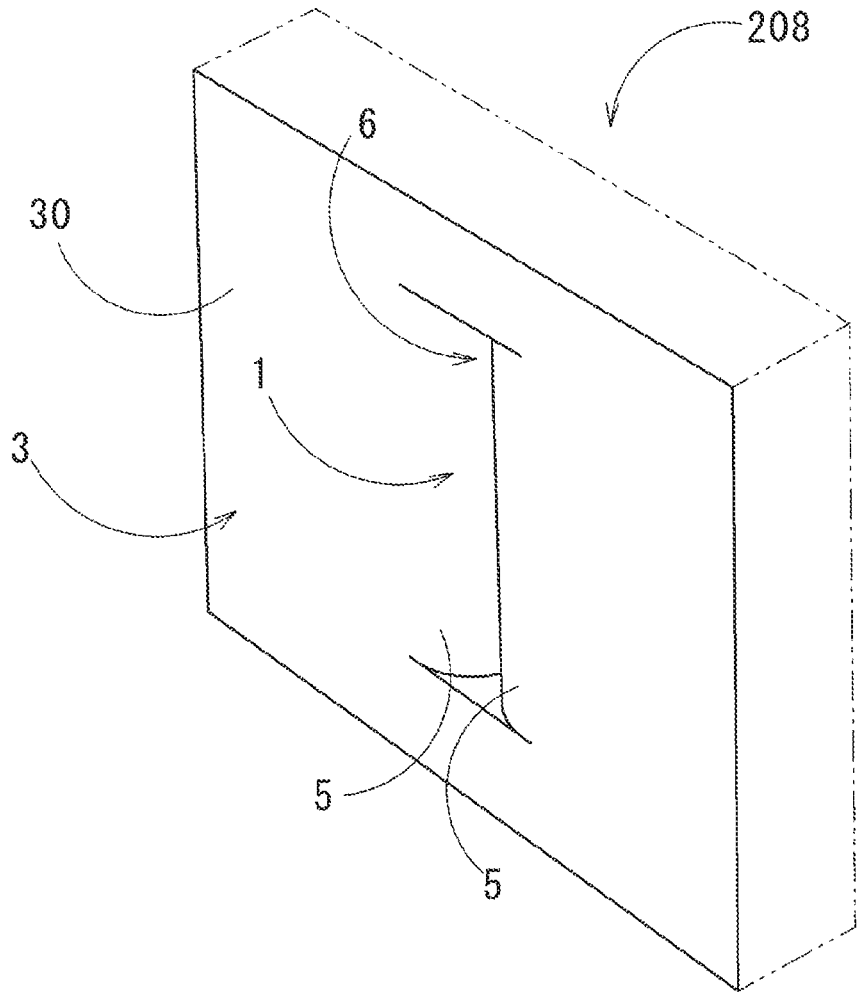

FIG. 9 schematically illustrates a perspective view of an eighth embodiment of a speaker according to the present invention.

Figure 10:
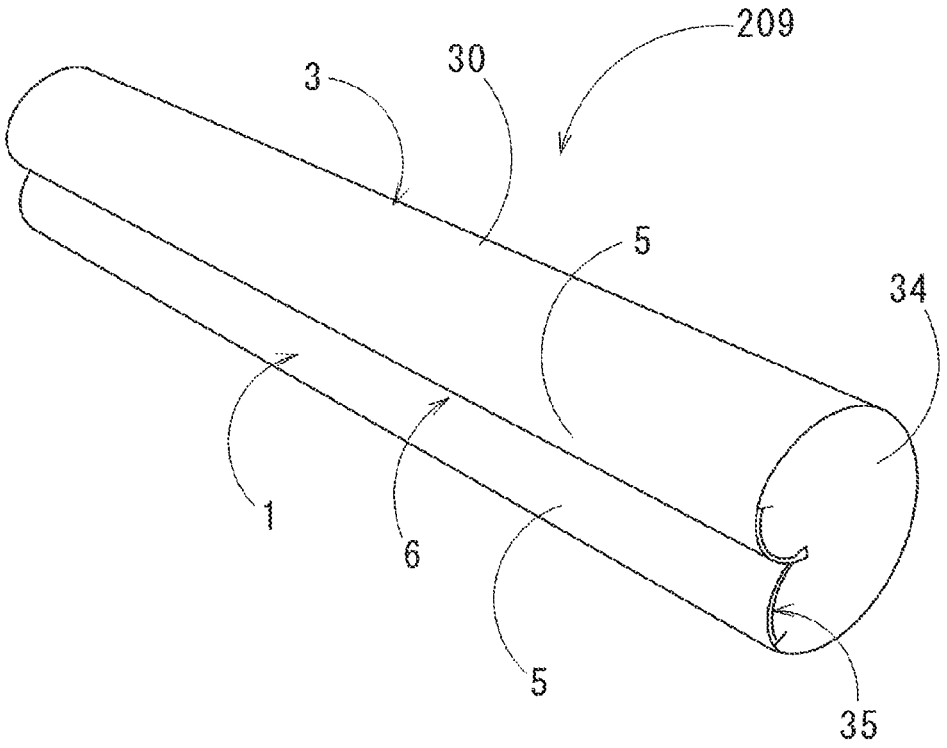

FIG. 10 schematically illustrates a perspective view of a ninth embodiment of a speaker according to the present invention.

Figure 11:
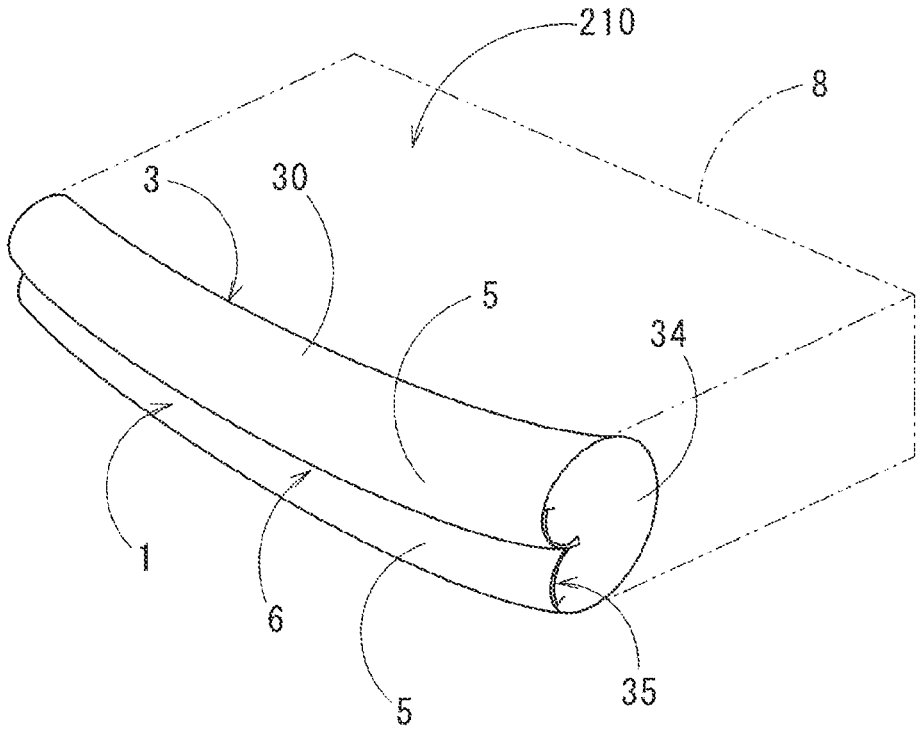

FIG. 11 schematically illustrates a perspective view of a tenth embodiment of a speaker according to the present invention.

Figure 12:
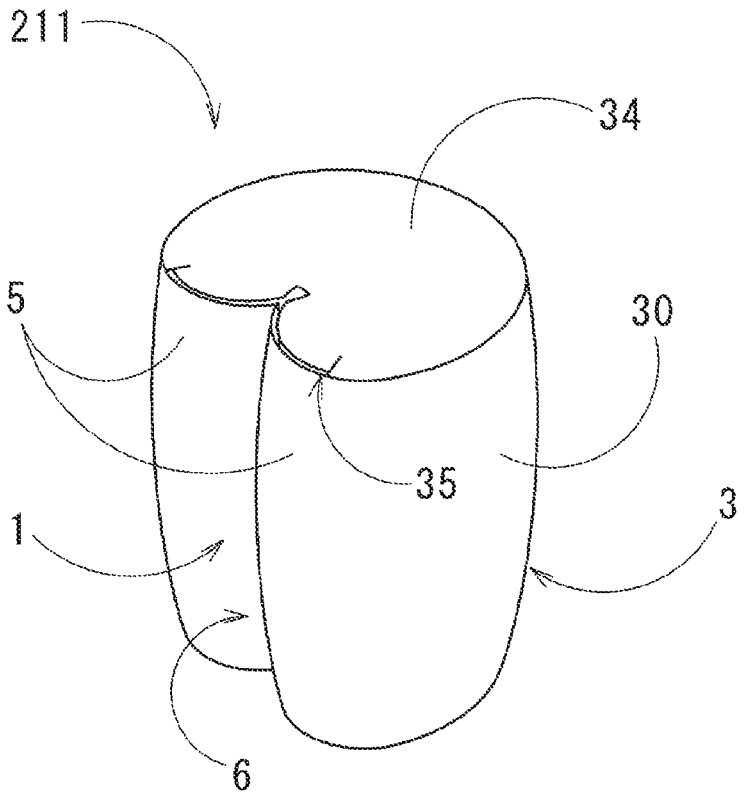

FIG. 12 schematically illustrates a perspective view of an eleventh embodiment of a speaker according to the present invention.

Figure 13:
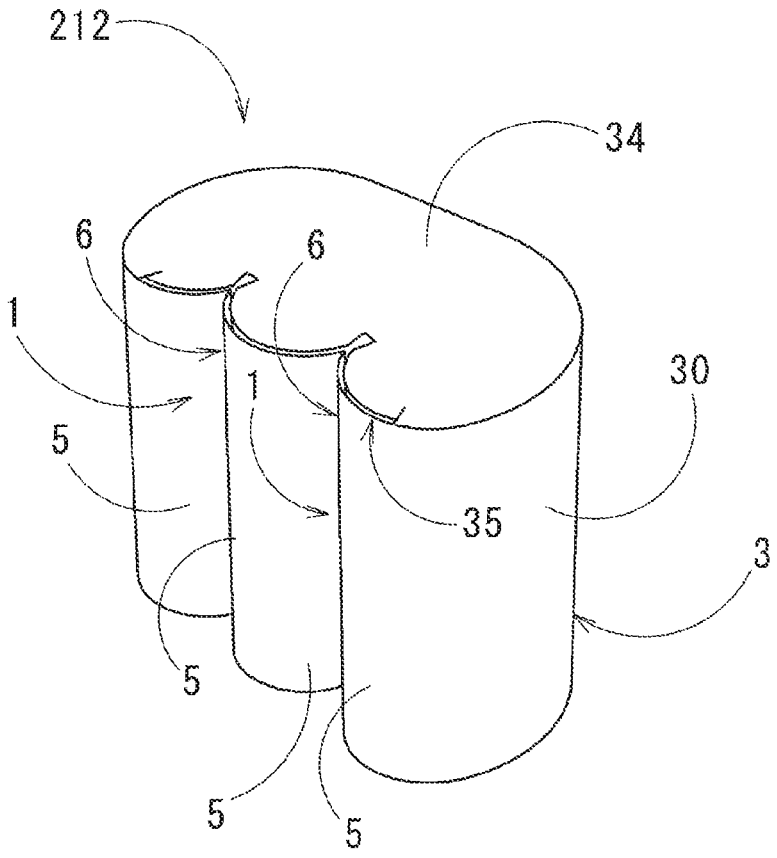

FIG. 13 schematically illustrates a perspective view of a twelfth embodiment of a speaker according to the present invention.

Figure 14:
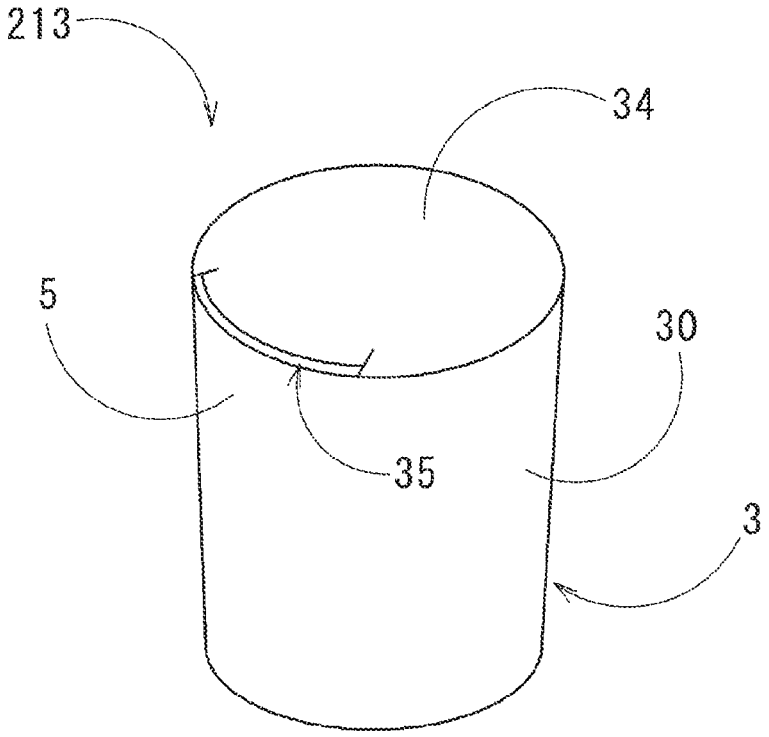

FIG. 14 schematically illustrates a perspective view of a thirteenth embodiment of a speaker according to the present invention.

DETAILED DESCRIPTION

The present invention relates to an electroacoustic transducer suitable as a speaker for reproducing sound or a microphone for collecting sound through the vibration of vertically split cylindrical faces, namely longitudinally divided cylindrical surfaces, providing a valley section and having a one side portion disposed on one side of the valley and the opposite side portion disposed on the opposite side of the valley. The electroacoustic transducer can produce excellent acoustic characteristics.

Present drawings illustrate the electroacoustic transducer according to the present invention in a form of a speaker.

Referring to FIGS. 1 and 2, which show a speaker according to a first embodiment, a speaker (electroacoustic transducer) 100 includes a vibrating body 1 having one or more vertically split cylindrical faces 5, namely at least one pair of longitudinally divided cylindrical surfaces providing a valley section (valley) 6, an actuator (conversion section) 2 reciprocating the vibrating body 1, and a housing 3 for supporting the vibrating body 1 and the actuator 2.

The vibrating body 1 has a surface shape where a pair of vertically split cylindrical faces 5 is formed in parallel and the valley section 6 is formed between one side sections (left side portion left of the valley and right side portion right of the valley) of the vertically split cylindrical faces 5 adjacent to each other. The vibrating body 1 shown as an example in the present figures is formed of a pair of curved plates 11. The pair of curved plates 11 are formed so as to be curved along the vertically split cylindrical faces 5, and the side sections of both the curved plates 11 are integrally joined to each other to form the valley section 6.

The above-mentioned vertically split cylindrical face 5 is a face obtained by vertically splitting and cutting out part of a cylindrical face, and the above-mentioned side section of the curved plate 11 is the side section of the curved plate 11 in the curving direction of the vertically split cylindrical face 5. Furthermore, in the vibrating body 1, the extending direction of the valley section 6 is the vertical direction, and the direction orthogonal to this direction is the horizontal direction.

Moreover, the material of the vibrating body 1 is not limited, and a material, such as synthetic resin, paper or metal, being generally used for the vibrating plate of a speaker can be used. The vibrating body can be formed relatively easily by vacuum forming a film of synthetic resin, such as polypropylene or polyester.

Both the curved plates 11 of the vibrating body 1 are integrally formed by folding back a sheet of film at its central section serving as a joining section 13, which can have a V-shape or a U-shape in cross section formed at the fold-back portion between both the curved plates 11. Both the curved plates 11 of the vibrating body 1 can also be formed by bonding one side sections of the curved plates 11 consisting of two sheets of film.

In addition, the vertically split cylindrical face 5 of the curved plate 11 is not necessarily required to have a single arc-shaped face, but it is possible to adopt faces, such as a face formed of continuous portions having a plurality of curvatures, a face having a constant curvature or a continuously changing curvature, for example, in the shape of a parabola or a spline curve in cross section in the circumferential direction (horizontal direction) of the vertically split cylindrical face 5, a rectangular cylindrical face, and a face with a plurality of stair-like step sections. The vertically split cylindrical face 5 of the curved plate 11 is curved in one direction (in the circumferential direction of the vertically split cylindrical face 5, namely the horizontal direction) and is linear in the direction (the vertical direction of the vertically split cylindrical face 5) orthogonal to the one direction.

Additionally, the pair of curved plates 11 can be disposed in parallel in a state where the convex directions thereof are oriented to the surface sides thereof in the same direction, and the side sections of the curved plates 11 adjacent to each other are joined to have a common tangential direction at the joining section 13. Still further, the valley section 6 is formed linearly between both the curved plates 11 along the joining section 13 in the vertical direction of the vertically split cylindrical faces 5.

Further, in order that uniform reproduction sound is obtained, both the curved plates 11 are preferably formed symmetrical with respect to the tangential line L of the curved plates 11 as shown in FIG. 2. The curved plates, however, are not necessarily required to be linearly symmetrical.

The actuator 2 is used to vibrate the valley section 6 of the vibrating body 1 in its depth direction, and a voice coil motor is used for example. In this embodiment, the actuator 2 includes a voice coil 20 provided at the joining section 13 of the curved plates 11 and a magnet mechanism 21 fixed to the supporting frame 32 of the housing 3 as shown in FIG. 2.

The voice coil 20 is formed of a coil **20*b* wound around a cylindrical bobbin 20*a*, and the upper end of the voice coil 20 is fixed to the lower edge of the joining section 13 via an adhesive or the like so that the joining section 13 of the curved plates 11 is disposed in the radial direction of the coil. Furthermore, the outer circumferential section of the voice coil 20 is supported by the supporting frame 32 via a damper 22, and the voice coil 20 is provided to be reciprocable with respect to the supporting frame 32 in the axial direction of the voice coil 20. A material being used for a general dynamic speaker can be applied to the damper 22**.

The magnet mechanism 21 includes an annular magnet 23, a ring-shaped outer yoke 24 fixed to one of the poles of this magnet 23 and an inner yoke 25 fixed to the other pole thereof. The tip end section of the pole section 25*a* provided at the center of the inner yoke 25 is disposed inside the outer yoke 24, whereby an annular magnetic gap 26 is formed between the outer yoke 24 and the inner yoke 25, and the end section of the voice coil 20 is inserted in this magnetic gap 26.

The housing 3 includes an exterior section 31 and the supporting frame 32 (32*a*, 32*b*, 32*c*) installed on the exterior section 31. The exterior section 31 can be made of a material, such as an MDF (medium density fiberboard) or a particle board, and can have a shape where part of the nearly cylindrical shape thereof is cut out in the cylinder axis direction (the vertical direction in FIG. 1) thereof. Inside the opening groove section 31 *a* having been cut out as described above, the supporting frame 32 is installed straddling the opening groove section 31*a*. Furthermore, a space section (chamber) 33 is formed in the region enclosed with the exterior section 31 and the vibrating body 1. The material of the exterior section 31 is not limited to the above-mentioned materials, and other materials can be used, provided that the materials are used for the housings of speakers.

At both the end sections of the space section 33 in the cylinder axis direction (the vertical direction) thereof, a pair of end plates 34 are provided to close both the ends of the space section 33 as shown in FIG. 1. Each of the end plates 34 is disposed such that a slight clearance 35 is provided between the end plate and the vibrating body 1 so as to not hinder the reciprocal movement of the vibrating body 1. A member made of a porous material (sponge material) or the like not affecting the reciprocal movement of the vibrating body 1 can be inserted into this clearance 35 to close the clearance 35.

The supporting frame 32 can be formed of a metallic material, for example, and at the opening groove section 31*a* of the exterior section 31, the supporting frame 32 can include the outside frame sections 32*a* fixed to the end sections of the inner circumferential face of the exterior section 31, the inclined plate sections 32*b* extending inward in the radial direction from the outside frame sections 32*a*, and the inside frame sections 32*c* formed at the lower ends of the inclined plate sections 32*b*. The magnet mechanism 21 is installed on the inside frame sections 32*c*.

Furthermore, at the opening groove section 31 *a* of the exterior section 31, the side sections of both the curved plates 11 of the vibrating body 1 (the side sections of the vertically split cylindrical faces 5) on the opposite side of the joining section 13 are fixed to the end sections (fixing sections 31*b*) of the outer circumferential face of the exterior section 31.

In addition, the vibrating body 1 extends beyond the side sections of the curved plates 11 (the side sections of the vertically split cylindrical faces 5) on the opposite side of the joining section 13 in the curving direction of both the curved plates 11. In other words, each of the curved plates 11 of the vibrating body 1 extends beyond the fixing section 31 *b* of the exterior section 31 to the outer circumferential face (the surface of the housing 3) of the exterior section 31 in the direction (indicated by arrow A in FIG. 2) to the side section of the vertically split cylindrical face 5.

The vibrating body 1 of the speaker 100 according to this embodiment is provided to entirely surround the outer circumferential face of the exterior section 31 of the housing 3 (the surface of the housing 3) in the directions to the side sections of the vertically split cylindrical faces 5, and the vertically split cylindrical faces 5 of the vibrating body 1 and the outer face 30 of the housing 3 are made of the same material and integrally formed. Hence, the vertically split cylindrical faces 5 of the vibrating body 1 and the outer face 30 of the housing 3 are formed into a continuous shape in the directions to the side sections of the vertically split cylindrical faces 5, so that the cross section of the speaker is formed into a heart shape as shown in FIG. 2.

In the speaker 100 configured as described above, the side sections of both the curved plates 11 of the vibrating body 1 (the side sections of the vertically split cylindrical faces 5) on the opposite sides of the joining section 13 are fixed to the fixing sections 31*b* (the end sections of the opening groove section 31*a*) of the exterior section 31 of the housing 3 as described above. On the other hand, the joining section 13 at which the side sections of both the curved plates 11 adjacent to each other are joined is provided to be vibrated by the actuator 2. Hence, when the drive current corresponding to a sound signal flows through the voice coil 20 of the actuator 2 fixed to the vibrating body 1 at the joining section 13, the drive force corresponding to the drive current is exerted to the voice coil 20 by the change in magnetic flux caused by the drive current and the magnetic field inside the magnetic gap 26, vibrating the voice coil 20 in the direction orthogonal to the magnetic field (in the axial direction of the voice coil 20, namely in the vertical direction indicated by arrows in FIG. 2). Hence, the vibrating body 1 connected to the voice coil 20 is vibrated in the depth direction of the valley section 6, and reproduction sound is radiated from the surface of the vibrating body 1.

Moreover, in the speaker 100, the vertically split cylindrical faces 5 of the vibrating body 1 and the outer face 30 of the housing 3, forming the external appearance of the speaker, are made of the same material, integrated and formed into a continuous shape in the directions to the side sections of the vertically split cylindrical faces 5. The vibrating body 1 and the housing 3 thus can have a design with a smooth integral feeling without these elements being distinguished from each other in appearance and can exhibit excellent design property.

Since the vertically split cylindrical faces 5 of the vibrating body 1 and the outer face 30 of the housing 3 are formed into the continuous shape, unwanted diffracted waves can be prevented from being generated from the connection portions between the vertically split cylindrical faces 5 and the outer face 30 of the housing 3. Since the outer face 30 of the housing 3 is formed into a curved face, diffracted waves can be suppressed from being generated from the housing 3. Accordingly, the directional characteristics and frequency characteristics of the sound radiated from the speaker 100 can be improved, whereby exhibit excellent acoustic characteristics can be exhibited.

Further, since the inner circumferential face of the exterior section 31 of the housing 3 is formed into a curved face, the generation of standing waves inside the housing 3 is suppressed, so that the frequency characteristics of the sound radiated from the speaker can also be improved.

Furthermore, since the vertically split cylindrical faces 5 of the vibrating body 1 and the outer face 30 of the housing 3 are made of the same material as in the speaker 100 according to the first embodiment, the vertically split cylindrical faces 5 of the vibrating body 1 and the outer face 30 of the housing 3 can be formed into a smooth shape having no joint, so that the integral feeling of the external appearance of the speaker can be further improved.

In the speaker 100 according to this embodiment, the exterior section 31 of the housing 3 is formed into a heart shape in cross section and the outer face 30 is formed only of a curved face. The housing 3, however, is not limited to this configuration. As in a speaker 202 according to a second embodiment, shown in FIG. 3, and a speaker 203 according to a third embodiment, shown in FIG. 4, even in a case where part of the exterior section 31 of the housing 3 has a flat face, since the vertically split cylindrical faces 5 of the vibrating body 1 and the outer face 30 of the housing 3 are made of the same material, the integral feeling of the external appearance of the speaker can be improved.

Moreover, the vertically split cylindrical faces 5 of the vibrating body 1 and the outer face 30 of the housing 3 need not be made of the same material, provided that they are formed into a continuous shape. But in a case where they are made of the same material as in the first embodiment, the effect of higher design property and sound property can be exhibited.

In the speaker 100 according to the first embodiment, the vibrating body 1 extends to the outer face 30 of the housing 3 in the directions to the side sections of the vertically split cylindrical faces 5 and provided to entirely surround the outer face 30 of the housing 3 (the surface of the housing 3). The necessity for ensuring the integral feeling of the external appearance, however, is low at the portion of the speaker that is not visible to the listener when the speaker is used, such as the rear face portion of the speaker, because the portion hardly influences the design property of the speaker. For this reason, the vibrating body 1 can be merely extend to at least the front face side of the housing 3 in the directions to the side sections of the vertically split cylindrical faces 5, and the vibrating body need not cover the rear face side of the speaker 100.

Further, since the upper and lower end plates 34 of the housing 3 are each formed of a flat face in the speaker 100, a line array speaker can be structured so that the end plates 34 of a plurality of speakers 100 are mutually connected so that the speakers 100 are arranged continuously in the cylinder axis direction (the vertical direction). In this case, the respective vibrating bodies 1 can be disposed continuously so that clearances are almost eliminated among them by aligning the valley sections 6 of the respective vibrating bodies 1 of the plurality of speakers 100 in the vertical direction. With this configuration, since the plural pairs of vertically split cylindrical faces 5 connected continuously function as a pair of vertically split cylindrical faces having a huge length, wide directional characteristics can be obtained in the left-right direction while limited directional characteristics are obtained in the vertical direction. Accordingly, it is possible to provide a speaker capable of radiating sound only to a desired area.

FIGS. 5 to 14 show speakers according to other embodiments. In these embodiments, since the components of the vibrating body and others are the same as those according to the first embodiment, the components common to those according to the first embodiment are designated by the same numerals in the respective figures and their descriptions are omitted.

A speaker 204 according to a fourth embodiment, shown in FIG. 5, is configured so that the vertically split cylindrical faces 5 of the vibrating body 1 and the outer face 30 of the housing 3 are provided as separate members. The side sections of the vertically split cylindrical faces 5 of the vibrating body 1 and the connection sections 31*c* at the end sections of the outer face 30 of the housing 3 connected to the side sections of the vertically split cylindrical faces 5 are formed flush with each other, so that they are smoothly connected and their tangential lines become continuous. Since the side sections of the vertically split cylindrical faces 5 of the vibrating body 1 and the connection sections 31*c* of the outer face 30 of the housing 3 are formed into the shape so that their surfaces are flush with each other, the vertically split cylindrical faces 5 of the vibrating body 1 and the connection sections 31*c* of the outer face 30 can have a design with an integral feeling and can exhibit excellent design property even in the case that they are not made of the same material.

A speaker 205 according to a fifth embodiment, shown in FIG. 6, is configured so that edge sections or edges (surrounds) 7 support the vibrating body 1 so that the vibrating body 1 can vibrate reciprocally in the depth direction (indicated by arrows B in FIG. 4) and are provided on the back faces of the side sections of the vertically split cylindrical faces 5 in addition to the configuration in which the vertically split cylindrical faces 5 of the vibrating body 1 and the outer face 30 of the housing 3 are formed as separate members according to the fourth embodiment described above. Since the side sections of the curved plates 11 of the vibrating body 1 are supported by the edge sections 7 in this case, the vibrating body 1 entirely vibrates uniformly, so that the vibration due to the so-called piston motion can be performed. Hence, as in a dynamic speaker, the speaker 205 can reproduce sound having high sound pressure even in the low frequency band, so that the reproduction frequency thereof can be expanded to the low frequency band. Also in the speaker 205 according to the fifth embodiment, the side sections of the vertically split cylindrical faces 5 and the connection sections 31*c* of the outer face 30 are formed flush with each other (the surfaces of the side sections of the vertically split cylindrical faces 5 are flush with the surfaces of the connection sections 31*c* of the outer face 30), so that design property is not impaired and excellent design property can be exhibited.

A speaker 206 according to a sixth embodiment, shown in FIG. 7, is configured such that two vibrating bodies 1 are provided, a flat section 36 is disposed between the two vibrating bodies 1, and the two vibrating bodies 1 are disposed side by side in the left-right direction via the flat section 36 so that the extending directions of the valley sections 6 thereof are parallel with each other. Furthermore, both the side sections 37 of the housing 3 have semi-cylindrical outer faces extended in the directions from the side sections of the vertically split cylindrical faces 5, and the outer face 30 of the housing 3 including both the side sections 37 and the flat section 36 and the vertically split cylindrical faces 5 of the two vibrating bodies 1 are made of the same material and integrally formed. As described above, the vibrating bodies 1 extend to the surface of housing 3 in the directions to the side sections of the vertically split cylindrical faces 5 and to entirely surround the surface of the housing 3. Also in the speaker 206 having the plurality of vibrating bodies 1 as described above, the vertically split cylindrical faces 5 of the vibrating bodies 1 and the outer face 30 of the housing 3 can be formed into a smooth shape having no joint, so that the integral feeling of the external appearance of the speaker can be improved.

Moreover, in this speaker 206, the actuator (not shown) for reciprocating each vibrating body 1 can be provided in the bottom section of the valley section 6 of each vibrating body 1. Hence, the speaker 206 can process the audio signals of two channels using the vibrating bodies 1. Moreover, a configuration where three vibrating bodies 1 are provided also can be obtained as in a speaker 207 according to a seventh embodiment, shown in FIG. 8, by additionally disposing a vibrating body 1 for the audio signal (for example, the center audio signal) of a third channel on the flat section 36 between the two vibrating bodies 1. The speaker 207 is configured so that the three vibrating bodies 1 are disposed side by side in the left-right direction via the flat sections 36 so that the extending directions of the valleys 6 thereof are parallel with one another. Furthermore, both the side sections 37 of the housing 3 having semi-cylindrical outer faces extended in the directions from the side sections of the vertically split cylindrical faces 5, and the outer face 30 of the housing 3 including both the side sections 37 and the flat sections 36 and the vertically split cylindrical faces 5 of the three vibrating bodies 1 are made of the same material and integrally formed. As described above, also in this speaker 207, as in the speaker 206 according to the sixth embodiment, the vibrating bodies 1 can be provided to extend to the surface of the housing 3 in the directions to the side sections of the vertically split cylindrical faces 5 and to entirely surround the surface of the housing 3.

Also in the speaker 206 according to the sixth embodiment and the speaker 207 according to the seventh embodiment, the vertically split cylindrical faces 5 of the vibrating bodies 1 and the outer face 30 of the housing 3, forming the external appearance of the speaker, can be formed into a continuous shape in the directions to the side sections of the vertically split cylindrical faces 5. Accordingly, as in the speaker 100 according to the first embodiment, the vibrating bodies 1 and the housing 3 can have design with a smooth integral feeling so as to not distinguish from each other in appearance.

Furthermore, with combinations of a plurality of vibrating bodies 1 as in the speaker 206 according to the sixth embodiment and the speaker 207 according to the seventh embodiment, stereo 2-channel audio signals, 2.1-channel audio signals (stereo 2-channel audio signals and 0.1-channel audio signal for bass sound) or 3-channel audio signals (stereo 2-channel audio signals and 1-channel audio signal for center) can be reproduced using a single speaker.

FIG. 9 shows a speaker 208 according to an eighth embodiment. In this speaker 208, the front-side outer face 30 of the housing 3 can be formed only of a flat face, the vertically split cylindrical faces 5 of the vibrating body 1, forming the external appearance of the speaker on the front side, can extend in the directions to the side sections thereof, so that the vertically split cylindrical faces 5 and the outer face 30 of the housing 3 are made of the same material and formed into a continuous shape.

The speaker 208 in which the front side of the housing 3 is formed only of a flat face as described above is incorporated to constitute part of the exterior (indicated by alternate long and two short lines in FIG. 9) of another product having speakers as shown in FIG. 9, so that the vibrating body 1 and the housing 3 are integrated with the above-mentioned product so as to not distinguish from the product in appearance, and the design of the product with a smooth appearance can be obtained.

FIG. 10 shows a speaker 209 according to a ninth embodiment. In this speaker 209, the vibrating body 1 thereof is made longer than that of the speaker 100 according to the first embodiment in the extending direction of the valley section 6. Although the speaker 100 according to the first embodiment is used in a state where the extending direction of the valley section 6 is disposed in the vertical direction, the speaker 209 according to the ninth embodiment can be used in a state where the extending direction of the valley section 6 is disposed in the left-right direction.

Furthermore, also in this speaker 209, as in the speaker 100 according to the first embodiment, the vibrating body 1 is provided to extend to the outer face 30 of the housing 3 in the directions to the side sections of the vertically split cylindrical faces 5 and to entirely surround the surface of the housing 3, and the vertically split cylindrical faces 5 and the outer face 30 are formed of the same material. Moreover, the speaker 209 is provided with a plurality (for example, two) of actuators, not shown, for reciprocating the vibrating body 1 at intervals in the extending direction of the valley section 6. Hence, the vibrating body 1 can be entirely vibrated uniformly in the extending direction of the valley section 6, so that the speaker can provide uniform sound in an area wider than the height of the speaker 209 in the vertical direction orthogonal to the extending direction of the valley section 6, and on the other hand, in an area limited to the width of the speaker 209 in the left-right direction along the extending direction of the valley section 6.

As in a speaker 210 according to a tenth embodiment, shown in FIG. 11, the speaker 210 can be entirely formed into a curved shape by pushing forward the central section of the valley section 6 of the vertically split cylindrical faces 5 in the extending direction thereof. Accordingly, in the speaker 210, the valley section 6 is also formed into a curved shape by pressing forward the central section thereof in the extending direction thereof.

In addition, as shown in FIG. 11, the speaker 210 can be united with a thin box-like rack 8 (indicated by alternate long and two short lines in the figure) on the rear side of the speaker 210. Furthermore, as in the speaker 209 according to the ninth embodiment, the speaker 210 is used in a state in which the extending direction of the valley section 6 is oriented in the left-right direction.

In this speaker 210, as in the speaker 100 according to the first embodiment, the vibrating body 1 is provided to extend to the outer face 30 of the housing 3 in the directions to the side sections of the vertically split cylindrical faces 5 and to entirely surround the surface of the housing 3, and the vertically split cylindrical faces 5 and the outer face 30 are formed of the same material. Moreover, the cross-sectional shape of the speaker in the directions to the side sections of the vertically split cylindrical faces 5 (in the direction orthogonal to the extending direction of the valley section 6) is the same at any position, as in the speaker 100 according to the first embodiment shown in FIG. 2. In addition, the speaker 209 can be formed into a curved shape by pushing forward the central sections of the vertically split cylindrical faces 5, so that the speaker can provide uniform sound in an area wider than the height of the speaker 209 in the vertical direction orthogonal to the extending direction of the valley section 6 and in an area wider than the width of the speaker 209 in the left-right direction along the extending direction of the valley section 6.

Furthermore, as in a speaker 211 according to the eleventh embodiment, shown in FIG. 12, the speaker can be formed into a barrel shape as a whole by using a configuration where the vertically split cylindrical faces 5 of the vibrating body 1 and the outer face 30 of the housing 3 are pushed forward at the central section of the valley section 6 in the extending direction thereof and are swollen in the left-right direction. In this case, the cross-sectional shape of the speaker in the directions to the side sections of the vertically split cylindrical faces 5 becomes gradually larger in the directions from both the side sections of the valley section 6 to the central section. Moreover, as in the speaker 100 according to the first embodiment, the speaker 211 is used in a state in which the extending direction of the valley section 6 is oriented in the vertical direction.

Also, in this speaker 211, as in the speaker 100 according to the first embodiment, the vibrating body 1 can extend to the outer face 30 of the housing 3 in the directions to the side sections of the vertically split cylindrical faces 5 and to entirely surround the surface of the housing 3, and the vertically split cylindrical faces 5 and the outer face 30 can be formed of the same material. Moreover, the speaker 211 is formed into a curved shape not only in the directions to the side sections of the vertically split cylindrical faces 5 but also in the extending direction of the valley section 6 by using a configuration in which the vertically split cylindrical faces 5 of the vibrating body 1 are pushed forward at the central section of the valley section 6 in the extending direction thereof and are swollen in the left-right direction. Accordingly, the speaker can provide uniform sound in an area wider than the height of the speaker 211 in the vertical direction along the extending direction of the valley section and in an area wider than the width of the speaker 211 in the left-right direction orthogonal to the extending direction of the valley section 6.

As in a speaker 212 according to the twelfth embodiment, shown in FIG. 13, the vibrating body 1 is formed into a continuously curved shape by mutually joining the side sections of plural pairs (for example, two pairs as shown in the figure) of vertically split cylindrical faces 5, so that the plural pairs of vertically split cylindrical faces 5 constituting the vibrating body 1 are united in the directions to the side sections of the vertically split cylindrical faces, and a speaker outputting audio signals of a plurality of channels (two channels in the configuration shown in the figure) can be configured.

In this speaker 212, unlike the speaker 206 according to the sixth embodiment and the speaker 208 according to the seventh embodiment, the side sections of the vertically split cylindrical faces 5 adjacent to each other are joined without providing the flat section 36 between the side sections of the plural pairs of vertically split cylindrical faces 5, so that the vertically split cylindrical faces 5 are united and the vibrating body 1 having a plurality of curved shapes is formed. Furthermore, the vibrating body 1 can extend to the outer face 30 of the housing 3 in the directions to the side sections of the vertically split cylindrical faces 5 and to entirely surround the surface of the housing 3, so that the vertically split cylindrical faces 5 and the outer face 30 can be formed of the same material.

On the other hand, unlike the case where the vibrating body 1 is formed of one or more pairs of vertically split cylindrical faces 5 as in the speaker 100 according to the first embodiment (see FIG. 1) or the speaker 212 according to the twelfth embodiment (see FIG. 12), the vibrating body 1 can be formed using a single vertically split cylindrical face 5 as in a speaker 213 according to the thirteenth embodiment, shown in FIG. 14. Also in this speaker 213, the vibrating body 1 can extend in the directions to the side sections of the vertically split cylindrical face 5 and to entirely surround the surface of the housing 3, so that the vertically split cylindrical face 5 and the outer face 30 can be formed of the same material.

Also in the speakers 210 to 213 having the above-mentioned various configurations, the vertically split cylindrical faces 5 of the vibrating bodies 1 and the outer face 30 of the housing 3, forming the external appearance of the speaker, can be formed into a continuous shape in the directions to the side sections of the vertically split cylindrical faces 5, so that the vibrating body 1 and the housing 3 can have design with a smooth integral feeling so as to not distinguish from each other in appearance.

The present invention is not limited to the above-mentioned embodiments but can be modified variously within the scope not departing from the gist of the present invention.

For example, although the voice coil motor is applied as a conversion section for reciprocating the vibrating body, a piezoelectric element or the like may be used instead of the voice coil motor.

Furthermore, although the present invention is applied to speakers in all the above-mentioned embodiments, the present invention can also be applied to microphones. In the case that the present invention is applied to speakers, a conversion section, such as a voice coil motor, converts an electrical signal based on an audio signal into the vibration of a vibrating body. When the present invention is applied to microphones, a voice coil motor or the like can also be used as a conversion section, and the conversion section in this case converts the vibration of the vibrating body that vibrates by receiving a sound wave into an electrical signal.

Although the speaker according to each embodiment of the present invention can be used singly as a speaker, the speaker can also be used, for example, as a piece of interior furniture by using a transmittable resin as the material constituting the vibrating body and the outer face of the housing (in the case of the configuration shown in FIG. 2, it is preferable that a transmittable resin should be used as the material of the vibrating body 1 and the outer face 30 of the housing 3 and as the material of the exterior section 31) and by illuminating the inside of the housing. Furthermore, the speaker also can be applied to constitute part of the exterior of another product having speakers, such as an electronic keyboard instrument.

The characteristics of the electroacoustic transducer according to the embodiments of the present invention described above will be briefly summarized and listed as described below.

An electroacoustic transducer according to the present invention includes a vibrating body having at least one pair of vertically split cylindrical faces, a housing having fixing sections that fix side sections of the vertically split cylindrical faces of the vibrating body, and a conversion section that converts a signal into vibration of the vibrating body. The vibrating body extend to a surface of the housing in directions to the side sections of the vertically split cylindrical faces instead of extending merely to the fixing sections.

Since the vibrating body is provided to extend to the surface of the housing in the directions to the side sections of the vertically split cylindrical faces, the vertically split cylindrical faces and the outer face of the housing, forming the external appearance of the electroacoustic transducer, can be made of the same material, integrated and formed into a shape having no joint. Hence, the vibrating body and the housing can have design with an integral feeling so as to not distinguish from each other in appearance and can exhibit excellent design property.

Furthermore, in the case that the electroacoustic transducer according to the present invention is applied to a speaker, since the vertically split cylindrical faces of the vibrating body and the outer face of the housing are formed into the continuous shape, unwanted diffracted waves can be prevented from being generated from the connection portions between the vertically split cylindrical faces and the outer face of the housing. Accordingly, the directional characteristics and frequency characteristics of the sound radiated from the speaker can be improved, so that excellent acoustic characteristics can be exhibited.

Moreover, in the electroacoustic transducer according to the present invention, the vibrating body can entirely surround the surface of the housing in the directions to the side sections of the vertically split cylindrical faces (formed to surround the entire circumference of the surface of the housing).

In the electroacoustic transducer according to the present invention, the front face side of the housing can be flat, the at least one pair of vertically split cylindrical faces can be a pair of vertically split cylindrical faces formed in parallel, one side sections of the pair of vertically split cylindrical faces can be connected to form a valley section, and the other side sections of the pair of vertically split cylindrical faces can extend to the surface of the housing along the flat face of the housing.

An electroacoustic transducer according to the present invention includes a vibrating body having one or more vertically split cylindrical faces, a housing having connection sections that are joined to side sections of the vertically split cylindrical faces of the vibrating body, and a conversion section that converts an electrical signal into vibration of the vibrating body. The side sections of the vertically split cylindrical faces can be flush with the connection sections of the housing.

Even in the case that the vertically split cylindrical faces of the vibrating body and the outer face of the housing are formed as separate members, design with an integral feeling can be obtained and excellent design property can be exhibited by making these faces flush with each other.

Further, in the electroacoustic transducer according to the present invention, for example, the one or more vertically split cylindrical faces can be a pair of vertically split cylindrical faces formed in parallel, and a valley section can be formed between the side sections of the vertically split cylindrical faces that are adjacent to each other.

Further, in the electroacoustic transducer according to the present invention, the pair of vertically split cylindrical faces and the housing can be formed as separate members and the side sections of the pair of vertically split cylindrical faces can be supported by edge sections formed on back faces of the connection sections of the housing to enable the vibrating body to be reciprocated in a depth direction of the valley section.

Although the present invention has been described in detail with reference to specific embodiments, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

The following is a list of reference numerals and corresponding features.

1 . . . vibrating body
2 . . . actuator (conversion section)
3 . . . housing
5 . . . vertically split cylindrical face/longitudinally divided cylindrical surfaces
6 . . . valley section
7 . . . edge section or surround
8 . . . rack
11 . . . curved plate
13 . . . joining section
20 . . . voice coil
20*a* . . . bobbin
20*b* . . . coil
21 . . . magnet mechanism
22 . . . damper
23 . . . magnet
24 . . . outer yoke
25 . . . inner yoke
25*a* . . . pole section
26 . . . magnetic gap
30 . . . outer face
31 . . . exterior section
31*a* . . . opening groove section
31*b* . . . fixing section
31*c* . . . connection section
32 . . . supporting frame:
32*a* . . . outside frame section
32*b* . . . inclined plate section
32*c* . . . inside frame section
33 . . . space section
34 . . . end plate
35 . . . clearance
36 . . . flat section
37 . . . both side sections
100 . . . speaker

What is claimed is:

1. An electroacoustic transducer comprising:

a vibrating body having at least a first pair of longitudinally divided cylindrical surfaces providing a first valley and having a first side portion on one side of the first valley and a second side portion on the opposite side of the first valley;

an actuator connected to the vibrating body and configured to convert one of an electrical signal into vibration of the vibrating body or vibration of the vibrating body into an electrical signal;

a housing defining a chamber with an opening having a first side and a second side; and a frame supporting the actuator and connected to the housing and straddling the opening thereof between the first side and the second side, with the actuator disposed inside the housing, wherein the first side portion of the vibrating body is attached to the housing at the first side of the opening, and the second side portion of the vibrating body is attached to the housing at the second side of the opening, which is opposite the first side of the opening, so that the vibrating body covers the opening.

2. The electroacoustic transducer according to claim 1, wherein:

the housing has, at the first side of the opening, a first end surface, and has, at the second side of the opening, a second end surface, and the first and second side portions of the vibrating body respectively extend past the first and second end surfaces and are connected to an exterior surface of the housing.

3. The electroacoustic transducer according to claim 2, wherein the first and second side portions of the vibrating body are also respectively attached to the first and second end surfaces of the housing.

4. The electroacoustic transducer according to claim 1, wherein the vibrating body extends completely around an exterior surface of the housing.

5. The electroacoustic transducer according to claim 1, wherein the first and second side portions of the vibrating body are disposed flush with exterior surfaces of the housing contiguous with the opening.

6. The electroacoustic transducer according to claim 1, wherein first and second ends of the first and second side portions of the vibrating body are respectively attached to the frame using a first edge and a second edge that are supported on the frame to enable the vibrating body to reciprocate in a depth direction of the first valley in relation to the housing.

7. The electroacoustic transducer according to claim 1, wherein the actuator includes a magnet mechanism fixed to the frame and a voice coil movably supported relative to the magnet mechanism and connected to the vibrating body where the first pair of longitudinally divided cylindrical surfaces meet.

8. The electroacoustic transducer according to claim 1, wherein the first pair of longitudinally divided cylindrical surfaces are disposed in parallel in relation to the opening of the housing.

9. The electroacoustic transducer according to claim 8, wherein:

the housing has a front flat face where the opening is provided, the first side portion of the vibrating body is disposed on a first side of the front flat face and the second side portion of the vibrating body is disposed on a second side of the front flat face.

10. The electroacoustic transducer according to claim 7, wherein the voice coil is configured to convert an electrical signal into vibration of the vibrating body to provide a speaker function.

11. The electroacoustic transducer according to claim 7, wherein the voice coil is configured to convert vibration of the vibrating body into an electrical signal to provide a microphone function.

12. The electroacoustic transducer according to claim 1, wherein the one side of the first valley is a left side of the first valley and the opposite side of the first valley is a right side of the first valley.

13. The electroacoustic transducer according to claim 1, wherein the one side of the first valley is a lower side of the first valley and the opposite side of the first valley is an upper side of the first valley.

14. The electroacoustic transducer according to claim 1, further comprising:

a second pair of longitudinally divided cylindrical surfaces providing a second valley.

15. The electroacoustic transducer according to claim 14, wherein the second pair of longitudinally divided cylindrical surfaces has an identical configuration as the first pair of longitudinally divided cylindrical surfaces.

16. The electroacoustic transducer according to claim 1, wherein the frame suspends the actuator so that the housing is not in contact with the actuator.

* * * * *